US005090578A

United States Patent [19]

Arnold

[11] Patent Number: 5,090,578

[45] Date of Patent: Feb. 25, 1992

[54] PORTABLE CLOTHES LINE DEVICE

[76] Inventor: Thomas N. Arnold, 286 Blue Hill Ave., Milton, Mass. 02186

[21] Appl. No.: 717,856

[22] Filed: Jun. 19, 1991

Related U.S. Application Data

[63] Continuation of Ser. No. 587,116, Sep. 24, 1990, abandoned.

[51] Int. Cl.[5] ..... A47F 5/00

[52] U.S. Cl. ..... 211/119; 211/119.6; 211/87; 211/94.5

[58] Field of Search ..... 211/119.01, 119.02, 211/119.03, 119.04, 119.05, 119.06, 119.07, 119.08, 119.09, 119.1, 119.16, 119.17, 87, 104, 1.3, 94.5

[56] References Cited

U.S. PATENT DOCUMENTS

| | | | |
|---|---|---|---|
| 348,882 | 9/1886 | Bolton et al. | 211/119.15 |
| 523,315 | 7/1894 | Jodoin | 211/119.16 X |
| 626,541 | 6/1899 | Hornback | 211/119.02 |
| 950,859 | 3/1910 | Michaud | 211/119.16 X |
| 1,107,488 | 8/1914 | Bujger | 211/119.16 X |
| 1,214,182 | 1/1917 | Kramer | 211/119.16 X |
| 1,245,901 | 11/1917 | Gorman | 211/94.5 |
| 1,493,264 | 5/1924 | Hennessy | 211/104 |
| 2,594,158 | 4/1952 | Hannameyer | 211/119.01 |
| 2,865,514 | 12/1958 | Goodman | 211/119.15 |
| 3,305,101 | 2/1967 | Mills | 211/87 |
| 3,477,660 | 11/1969 | Abraham | 211/119.03 |
| 3,627,142 | 12/1971 | Steiner | 211/119.1 |
| 3,647,073 | 3/1972 | Steiner | 211/1.3 |
| 3,706,105 | 12/1972 | Nicholas et al. | 211/88 X |

FOREIGN PATENT DOCUMENTS

| | | | |
|---|---|---|---|
| 660679 | 2/1964 | Italy | 211/119.16 |
| 729515 | 12/1966 | Italy | 211/1.3 |

*Primary Examiner*—Robert W. Gibson, Jr.
*Attorney, Agent, or Firm*—John P. McGonagle

[57] ABSTRACT

A new and improved portable clothes line. Individual clothes line units are stored within a central housing which is mounted on a window ledge, railing or bannister. The clothes line units are cranked out from the central housing in a parallel arrangement to the housing along channels in rods folded out from the housing ends.

8 Claims, 4 Drawing Sheets

PORTABLE CLOTHES LINE DEVICE

The present application is a continuation-in-part of Ser. No. 587,116, filed Sept. 24, 1990, now abandoned.

BACKGROUND OF THE INVENTION

This invention relates to a portable clothes line unit, and more particularly to a portable clothes line device with clothes line units extendable along fold up rods extending from a base housing unit.

Conventional clothes lines which are designed for use in confined areas generally consist of spring-loaded rollers which dispense a set of cords to a desired second location. One notable drawback of this type of arrangement resides in the inability to always reach a convenient or desired second location. A second drawback of this type of arrangement resides in the inability to accommodate the use of the clothes lines to the existing washing load as all of the clothes lines of the prior art generally must be drawn out or extended.

In trying to overcome the limitations in prior art devices other arrangements have included pulling a number of wound-up clothes lines out from a central bracket member with pivoting rods. These types of devices are difficult to use without dangerously reaching out over the clothes lines when such devices are used on a window ledge or high railing or bannister.

SUMMARY OF THE INVENTION

In view of the foregoing disadvantages inherent in the known types of devices now present in the prior art, the present invention provides an improved portable clothes line. As such, the general purpose of the present invention, which will be described subsequently in greater detail, is to provide a new and improved portable clothes line device. To attain this the present invention has individual clothes line units stored within a central housing which is mounted on a window ledge, railing or bannister. The clothes line units are cranked out from the central housing in a parallel arrangement to the housing along channels in rods folded out from the housing ends.

This together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE PREFERRED EMBODIMENT

Figure 1:
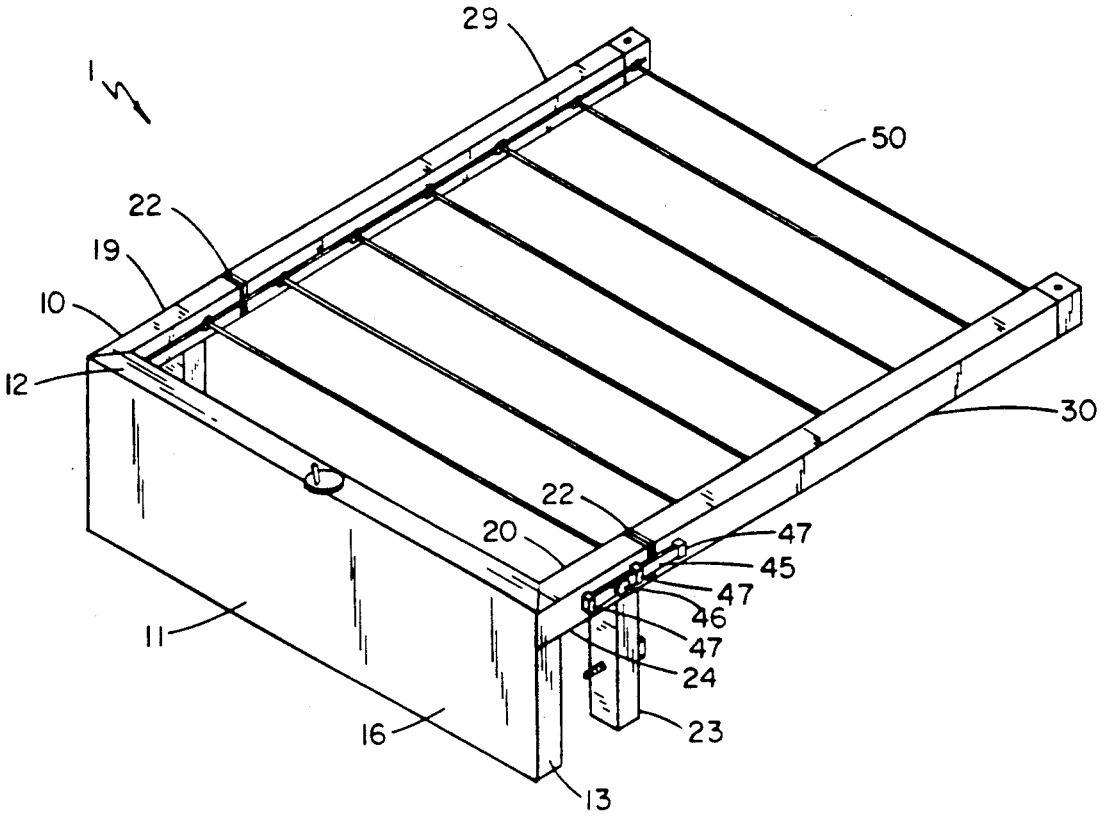
FIG. 1 is a perspective view of a preferred embodiment of the invention in use.

Referring to the drawings in detail wherein like elements are indicated by like numerals, there is shown a portable clothes line device 1 incorporating the principle features of the present invention. The invention 1 has a brace housing 10, two lateral support rods 29 and 30, and a plurality of individual clothes line units 50.

Figure 2:
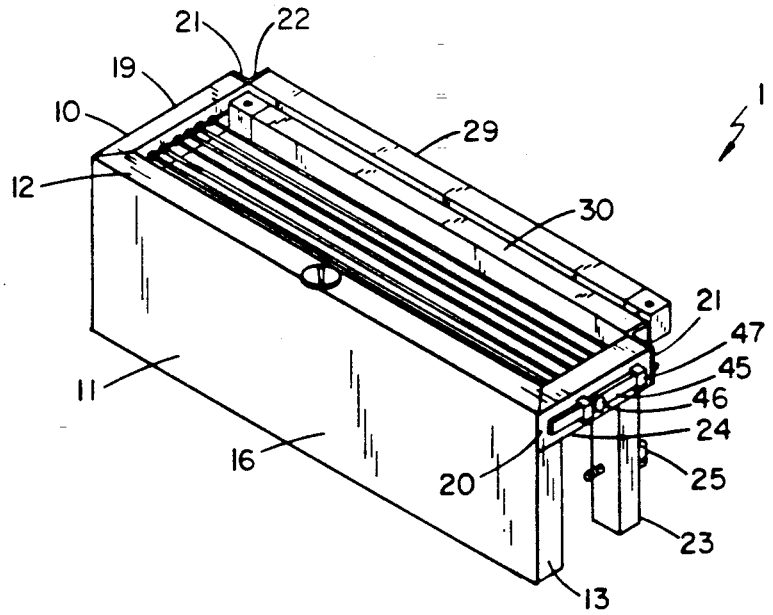
FIG. 2 is a similar view with the invention in its folded up configuration.
Figure 3:
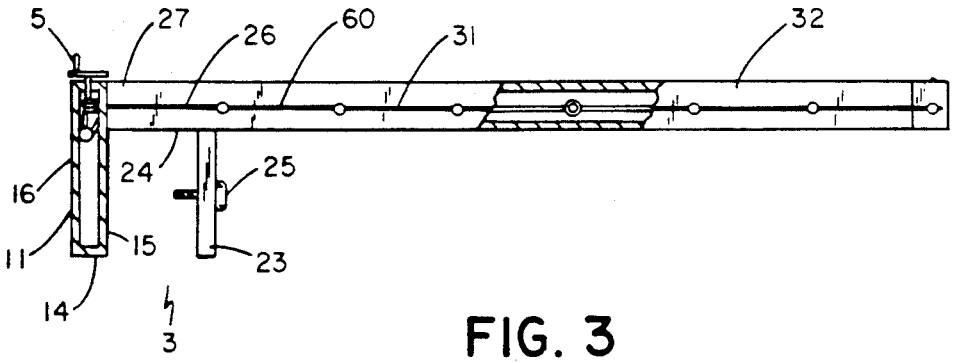
FIG. 3 is a sectional view of the invention along the line 3—3 of FIG. 4A.
Figure 4A:
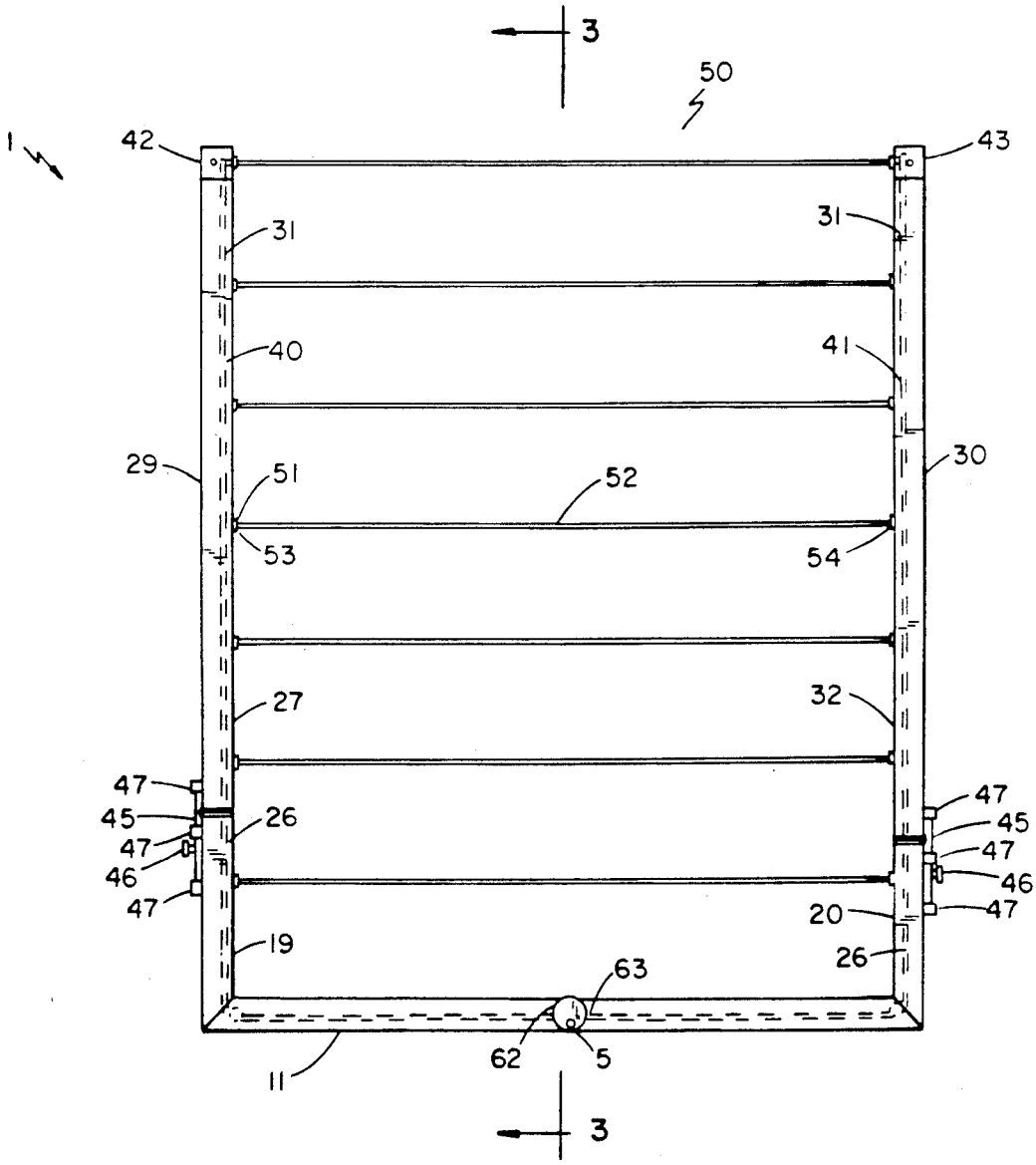
FIG. 4A is a top plan view of the portable clothes line device depicted in FIG. 1 fully extended.
Figure 4B:
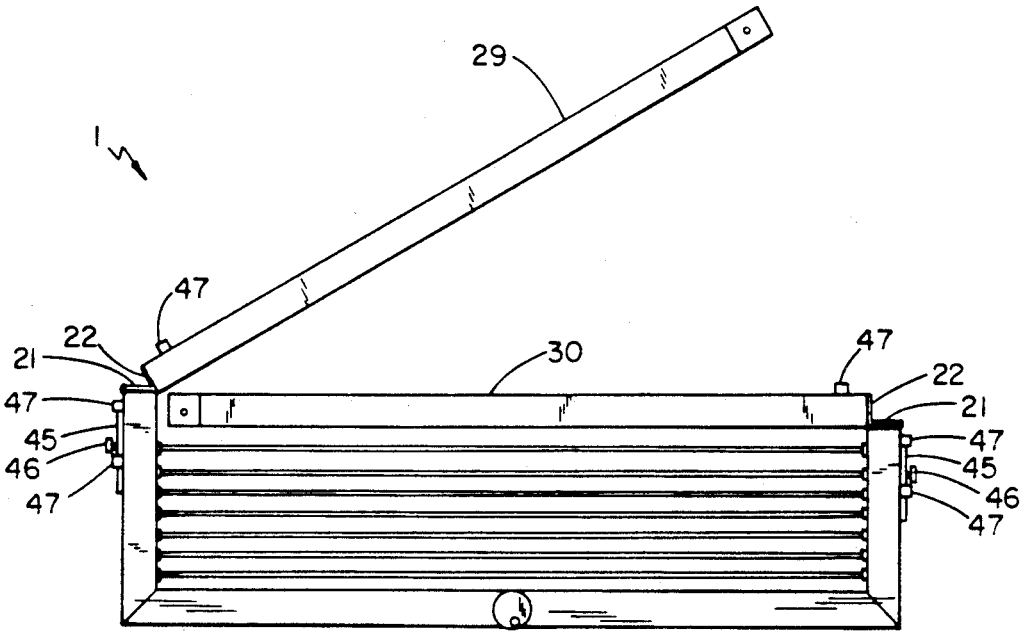
FIG. 4B is a top plan view of the portable clothes line device depicted in FIG. 1 partially folded.
Figure 5:
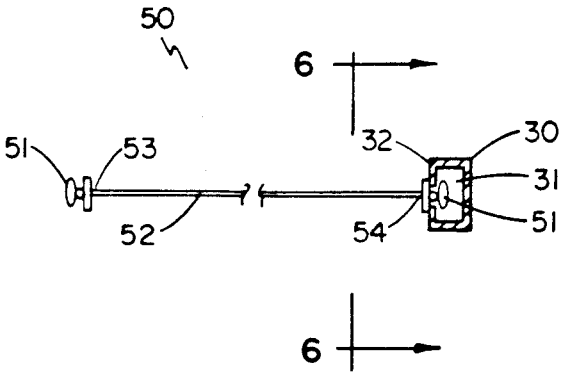
FIG. 5 is an elevational view of a clothes line unit used in the present invention.
Figure 6:
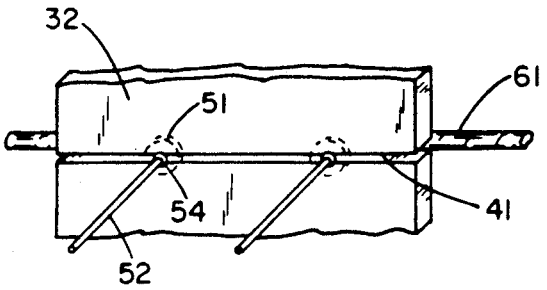
FIG. 6 is a perspective view in section along the lines 6—6 of FIG. 5 of a clothes line unit connected to a rod.
Figure 7:
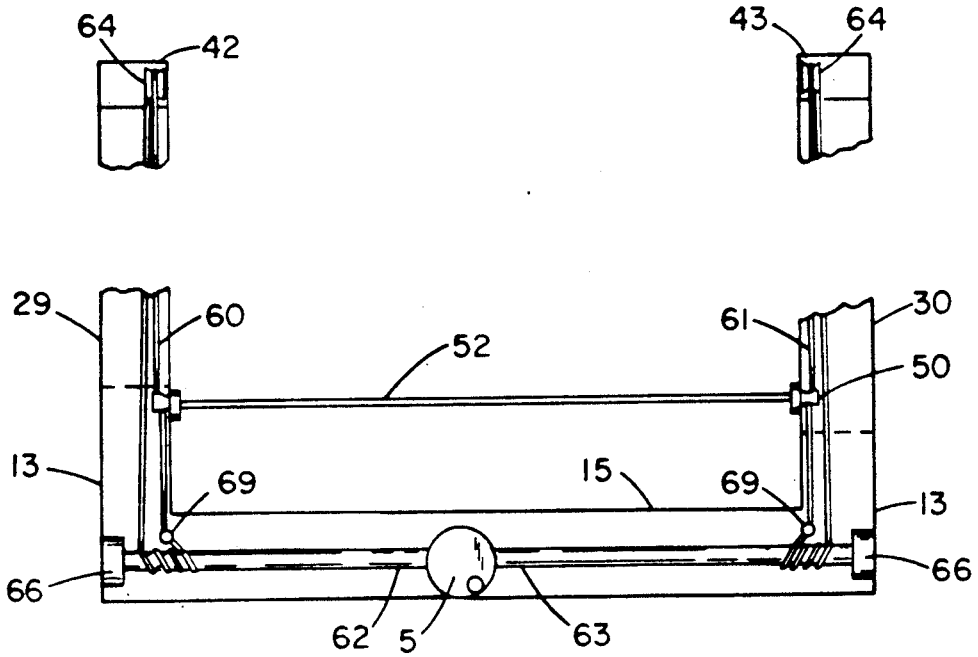
FIG. 7 is a partial sectional view of FIG. 4A.
Figure 8:
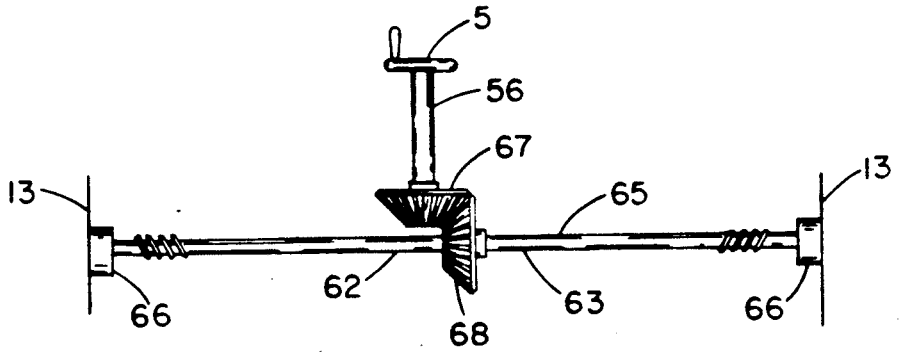
FIG. 8 is a rear sectional view of the housing member.

The brace housing 10 has a rectangular vertical housing member 11 with a top 12, two sides 13, a bottom 14, a front face 15 and a rear face 16. The housing member 11 has two short support stubs 19 and 20 attached to the housing member sides 13 near to the housing member top 12 and extending in the same direction perpendicular and horizontally out from the housing member front face 15. The unattached outer ends 21 of the stubs 19 and 20 terminate in pivotal joints 22. Lateral support rods 29 or 30 are joined to each pivotal joint 22. In one position, the support rods 29 and 30 extend horizontally outward from the pivotal joints 22 in the same longitudinal axis as their corresponding stub 19 or 20. In their alternate position, the lateral support rods 29 and 30 are folded 90 degrees inward toward the vertical housing member 11. The support stubs 19 and 20 and corresponding support rods 29 and 30 are of different lengths for compactness when the invention 1 is fully folded. See FIG. 2. The left stub 19 is longer than the right stub 20. However, the left rod 29 is shorter than the right rod 30, so that the invention 1 is symmetrical when fully opened. See FIGS. 1, 2 and 4A.

Each stub 19, 20 has a downwardly projecting projecting vertical brace member 23 attached to its underside 24 toward its outer end 21, just before the pivotal joint 22. The brace members 23 and vertical housing 11 interconnected by the stubs 19 and 20 form a downwardly projecting "U" shaped brace 3 which when placed over a window sill, bannister or railing hold the invention in place. An adjustment screw 25 in each of the vertical brace members 23 provides means for tightly securing the invention 1 to a window sill, bannister or railing.

The stubs 19, 20 and support rods 29, 30 have coincident grooved "T" shaped channels 26 and 31 along the longitudinal axis of their inner sides 27 and 32. The channels 26 and 31 in the left stub 19 and left support rod 29 form a left channel 40. The channels 26 and 31 in the right stub 20 and support rod 30 form a right channel 41. The left 40 and right 41 channels thereby formed face each other. Within each channel 40 and 41 there is placed a number of slidable T-shaped line holders 51. Each holder 51 in the left channel 40 has one end 53 of a length of clothes line 52 attached thereto. The other end 54 of each length of clothes line 52 is attached to a corresponding holder 51 in the right channel 41. A clothes line unit 50 is formed by one length of clothes line 52 with a holder 51 at each line end 53 and 54.

Each lateral support rod 29, 30 and support stub 19, 20 has a slidable, interconnected bolt 45 for bracing the lateral support rods 29, 30 in the extended position. Each rod 29, 30 has a vertical clamp 47 attached thereto near to the pivotal joints 22. Each support stub 19, 20 has two vertical clamps 47 attached thereto, one adjacent to the pivotal joints 22 and the second a short distance away toward the housing member 11. The slid bolt 45 is slidably secured within the support stub clamps 47. A handle 46 attached to the slid bolt 45 prevents the slid bolt 45 from sliding completely out of its position within the two stub clamps 47. When the lateral support rods 29, 30 are folded up, the slid bolts 45 are slid rearward toward the housing member 11. When the lateral support rods 29, 30 are in the extended position, the slid bolts 45 are slid forward so that the forward end of each bolt 45 engages the clamps 47 attached to the support rods 29, 30. This action, locks the lateral support rods 29, 30 in the extended position.

The holders 51 in the left channel 40 are interconnected to each other in a pulley arrangement in the same fashion as a drapery pulley. The holders 51 in the right channel 41 are interconnected in the same manner.

As may be best understood from FIGS. 4A, 5, 6, 7 and 8, the crank 5 in this embodiment a crank 5 centrally located on the vertical housing top 12 is extended by a rod 56 to a horizontally positioned bevel gear 67. Turning the crank 5 will cause the bevel gear 67 to turn in a horizontal plane. The crank gear 67 engages a vertically positioned drive rod bevel gear 68 through which a drive rod 65 is positioned and attached. As the crank gear 67 is turned, it causes the drive rod gear 68 to turn through a vertical plane thereby causing the drive rod 65 to radially rotate. The drive rod 65 is positioned in a horizontal plane extending from one housing side 13 to the other 13. The drive rod ends are rotatably seated within sockets 66 attached to insides of the housing sides 13. Two pulley ropes 60 and 61 engage each drive rod side 62 and 63, respectively. Each pulley rope 60, 61 is adaptively engaged to the drive rod 65 so as to act as a loop. Each pulley loop 60, 61 passes by a guide wheel 69 and sequentially connects to each T-shaped holder 51 in their respective channels 40, 41. After the last holder 51 is attached, the each respective loop 60, 61 passes over a guide wheel 64 locates at the farthermost point 42, 43 of each lateral rod 29, 30. Each loop 60, 61 is then brought directly back to the drive rod 65. The loop arrangement about the drive rod 65 avoids conflicts between and provides mutual support when the holders 51 are being slid outwardly or inwardly along the channels 40 and 41. When the support rods 29 and 30 are to be folded in toward the housing member 11, the line holders 51 are first retracted into the stub channels 26, and then optionally into the vertical housing member 11. When the support rods 29 and 30 are extended into their outward lateral positions, the crank 5 is used to extend the clothes line units 50 out onto the support rod channels 31. This permits a user to load clothing onto one line 52 at a time before extending a clothes line unit 50 out onto the support rods 30. This avoids the dangers of prior art devices whereby users must dangerously lean out a window or other a bannister or railing to load clothing onto a clothes line. Since wet clothing is heavy, the invention is much easier to use as less muscle power is needed to load clothing onto a clothes line immediately outside a window than to extend out from the window and attempt to load wet clothing onto a line further out from the window. Removal of the clothing when it is dry is also consequently easier. Only as many lines 52 as are necessary to accommodate a particular wash load need to be used in the present invention 1. The unused line units 50 would remain in their retracted positions.

It is understood that the above-described embodiment is merely illustrative of the application. Other embodiments may be readily devised by those skilled in the art which will embody the principles of the invention and fall within the spirit and scope thereof. The hand crank 5 shown in the preferred embodiment could easily me replaced with an electric motor.

I claim:

1. An improved portable clothes line device, comprising:

a "U"-shaped brace housing having a vertical housing member with top, two sides, bottom, a vertical inner face, and a vertical outer face, and having two support stubs extending horizontally outward from the vertical housing member sides near to the member top in planes perpendicular to the housing member's outer face, wherein each stub has a vertical brace member extending downwardly from the stub's unattached end;

two pivotal joints attached one each to the unattached end of each stub;

two lateral support rods each of which having two ends one of which is attached one each to a pivotal joint; and a plurality of clothes line units each of which is connected between said support rods.

2. A clothes line device as recited in claim 1 wherein:

each stub has an inner face along is horizontal portion and a central groove-like channel along the longitudinal axis of its inner face; and each support rod has an inner face and a central groove-like channel along the longitudinal axis of its inner face.

3. A clothes line device as recited in claim 2 wherein:

each clothes line unit is comprised of a length of clothes line and a generally "H" shaped holder attached to each end of each length of line.

4. A clothes line device as recited in claim 3 wherein:

each stub channel and the channel of its pivotally connected support rod, form a continuous, longitudinal device channel thereby resulting in two device channels facing each other.

5. A clothes line device as recited in claim 4 wherein:

each holder of a length of clothes line is slidably positioned within a separate device channel.

6. A clothes line device as recited in claim 5 wherein:

the holders in each channel are interconnected in a pulley arrangement one end of which terminates in a windup crank contained in the brace housing, wherein the holders in each channel may be synchronously extended out in the device channels or drawn in to the stub channels.

7. A clothes line device as recited in claim 6 wherein:

the pivotal joints are so connected to a stub and a support rod that the support rod remains in the same horizontal plane, and has a position range from 0 degrees against the vertical housing member to 90 degrees out from the vertical housing member.

8. A clothes line device as recited in claim 7 wherein:

each stub vertical brace member has an adjustment screw for tightly securing the device to a window sill, bannister or railing.

* * * * *